United States Patent [19]

Eve

[11] Patent Number: 4,793,011

[45] Date of Patent: Dec. 27, 1988

[54] FOLDING BED AND CABINET

[76] Inventor: Melvin E. Eve, 1711 Anchovy Ave., San Pedro, Calif. 90732

[21] Appl. No.: 58,242

[22] Filed: Jun. 4, 1987

[51] Int. Cl.[4] ..... A47C 19/06

[52] U.S. Cl. ..... 5/136; 5/149; 5/155; 5/159 R; 5/160

[58] Field of Search ..... 5/5, 136, 149, 150 R, 5/150 B, 155, 159 R, 160, 164 R, 164 C

[56] References Cited

U.S. PATENT DOCUMENTS

| | | | |
|---|---|---|---|
| 791,857 | 6/1905 | Arnold | 5/164 R |
| 1,289,844 | 12/1918 | McCrancy | 5/160 |
| 2,641,000 | 6/1953 | Jonsson | 5/155 |
| 3,097,369 | 6/1963 | Emch | 5/164 R X |
| 3,828,375 | 8/1974 | Driver | 5/164 C X |
| 3,852,837 | 12/1974 | Eakins | 5/155 |
| 3,858,253 | 1/1975 | Lauzon | 5/164 R X |

*Primary Examiner*—Michael F. Trettel
*Attorney, Agent, or Firm*—Cislo & Thomas

[57] ABSTRACT

A combination cabinet and folding bed wherein the bed may be stored in the cabinet. The cabinet can be used for other purposes, for example, a drop-down shelf on one or more sides can be provided. The folding bed is a unique arrangement of three pallets that can open out from the cabinet into a continuous horizontal surface or can fold back on each other in substantially a ⊔ configuration and can be stored in the cabinet in an upside down ⊔ configuration.

7 Claims, 3 Drawing Sheets

FOLDING BED AND CABINET

This invention relates to folding beds and more particularly to folding beds which, in the stored position, are enclosed by a cabinet or similar furniture.

BACKGROUND OF THE INVENTION

Folding beds have been used for sometime and are particularly useful in living arrangements of relatively limited space. When the bed is not in use, it can be folded up and put out of the way. In a one bedroom apartment, for instance, this is very beneficial.

The use of a folding bed with a storage cabinet is also known in the art. For example, U.S. Pat. No. 2,073,293 discloses a structure comprising a folding bed with storage cabinet in which the storage cabinet can also serve as a desk. U.S. Pat. No. 2,544,762 discloses a structure comprising a folding bed and a storage cabinet in which the storage cabinet has the proportions and appearance of a chest of drawers; the top portion of the cabinet, in fact, includes a drawer. U.S. Pat. No. 3,755,832 discloses a folding bed and cabinet combination in which the frame of the bed in the open position becomes the walls and top of the cabinet in the closed position; the patented structure also contains means for dropping the upper portion of the front panel to a horizontal position so that it may be used as a writing desk or serving area.

OBJECTS AND SUMMARY OF THE INVENTION

It is an object of the present invention to simplify and enhance a folding bed and cabinet combination.

It is another object of this invention to provide a unique three-part folding structure for the bed proper.

It is still another object of this invention to form the main horizontal support of the bed in the open position from three pallets that are so connected that they can assume substantially an upside down ⌐ shape in the folded position.

It is another object of the invention to provide a cabinet which in the closed position can be used as a utility bar or counter.

It is a further object of the invention to provide drop-down structures which act as legs for each pallet when the bed is opened and which fold flat against their own pallet when the bed is closed.

It is a further object of the invention to arrange the three pallets so that in the folded position they can substantially encompass a two-part center-hinged mattress which has been folded on itself.

A further object is to provide means to counterbalance the weight of the bed when removing it from or closing it into the cabinet.

It is a further object of the invention to provide means for readily assembling and disassembling the bed portion and the cabinet portion to and from each other.

My invention is a simplified and enhanced combination of a folding bed and cabinet. The bed portion comprises three interconnected pallets which can be opened so that the pallets can form a horizontal position with the outer edge of an inner pallet foldably connected to the inner edge of a middle pallet, and the outer edge of the middle pallet is foldably connected to the inner edge of a outer pallet. The connections between pallets may be through hinges or other means that will also permit the outer pallet to overlie in spaced relationship the inner pallet and the middle pallet can form a substantially right angle with both the inner and the outer pallets.

The bed portion can be adapted to any size, including twin, full, queen and king size; it may be constructed to fold out lengthwise or constructed to unfold widthwise to the cabinet. Under each pallet part, there is a supporting leg when the bed is in the open position. These structures can in turn be folded flat against the individual pallet section when the bed is folded.

In a preferred embodiment, the supporting legs are rectangular frames and the one under the inner pallet can be a solid frame so that it will serve as an external shelf when the bed is stored. This is possible because this pallet leg is located at the upper portion of the cabinet front in the closed position.

The inner pallet is attached to the lower front section of the cabinet by means which will permit the bed to be swung downward and forwardly from the cabinet into a horizontal position or upwardly and rearwardly into the cabinet in a stored position; the lower front section of the cabinet also support the pallet in the open position.

A BRIEF DESCRIPTION OF THE DRAWINGS

DESCRIPTION OF THE BEST EMBODIMENTS CONTEMPLATED

In the several figures, the same numbers refer to the same or corresponding parts.

Figure 1:
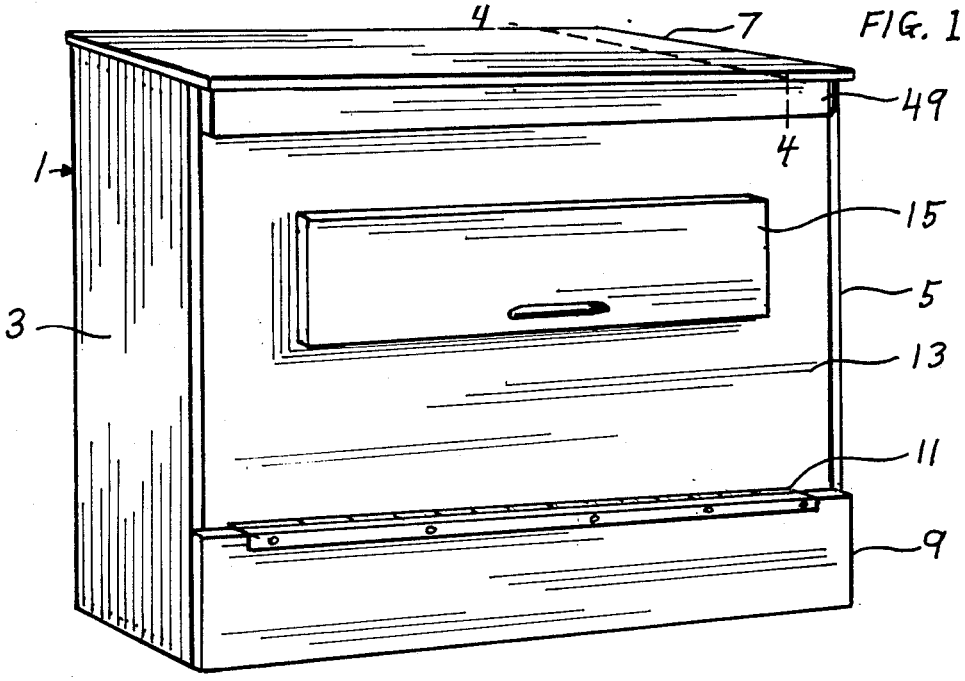
FIG. 1 is a perspective view of a cabinet of the present invention in the closed position.

FIG. 1 shows the cabinet 1 of the present invention in the closed position. It comprises sides 3 and 5, top 7, a secured front panel 9, hinge 11, upper front panel 13, cross piece 49 secured to upper front panel 13, and combination shelf and leg 15. Upper front panel 13 and secured front panel 9 are joined through hinge 11 so as to permit upper front panel 13 to move downwardly and forwardly out of the cabinet into a horizontal position.

Figure 2:
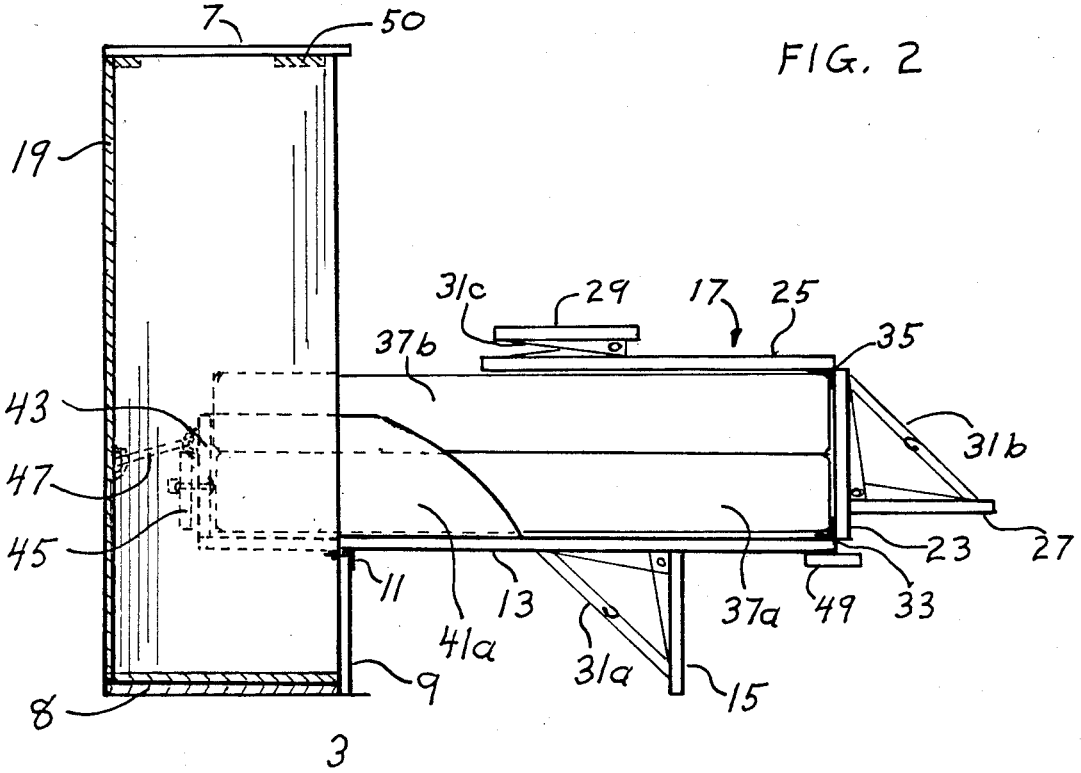
FIG. 2 is a side elevational view of the present invention with the bed portion partially in the horizontal position and partially in the folded position.

In FIG. 2, bed 17 is illustrated in a partially withdrawn position from cabinet 1. Cabinet 1 is so constructed that back 19 and bottom 8, shown in phantom butts up against and into sides 3 and 5. Stiffening board 50, shown in phantom, is on the under side of top 7 and slightly recessed from the front thereof; it strengthens top 7 and also acts to limit the inward swing of upper front panel 13 when bed 17 in closed.

Bed 17 comprises inner pallet 13, middle pallet 23, and outer pallet 25. Inner pallet is also upper front panel 13 when the bed 17 is enclosed in cabinet 1. Attached to each pallet such that they are on the bottom side of their respective pallets when the bed is in the horizontal position are support legs 15, 27, and 29; leg 15 is attached to pallet 13; leg 27 is attached to middle pallet 23; and leg 29 is attached to the outer pallet 25. Each support leg 15, 27, and 29 are held in place, both in the open and the closed position, through collapsible shelf brackets 31*a*, 31*b* and 31*c*, respectively.

In FIG. 2, support leg 15 and collapsible bracket 31*a* are shown in the open and supporting position. Supporting leg 27 and collapsible bracket 31*b* are illustrated in the open position but not in a support position. Support leg 29 and collapsible bracket 31*c* are illustrated in the closed position.

Pallet 13 is secured at its outer edge to the inner edge of pallet 23 through hinge 33. Pallet 23 is secured through its outer edge to the inner edge of pallet 25 through hinge 35. Hinges 11, 33, and 35 can run substantially the width of pallets 13, 27, and 29, respectively, or they can be multiple smaller hinges spaced apart along the edges not shown). Hinges 33 and 35 permit pallet 23 and pallet 25 to form a 90° angle with pallets 13 and 23, respectively, in the folded position; hinges 33 and 35 also permit pallets 13, 23, and 25 to open into a continuous horizontal position, as illustrated in FIG. 3.

Pallet 13 is approximately one-half the length of mattress 37. Pallet 23 and pallet 25 combined are also approximately one-half the length of mattress 37. The length of pallet 23, i.e., the distance between hinges 33 and 35, is approximately twice the thickness of mattress 37. Thus, when mattress sections 37*a* and 37*b* are folded on each other, they fit snugly between pallet sections 13 and 25 and are supported in the closed position by sideboards 41*a* and 41*b* and headboard 43.

Affixed to the inner edge of the bed and the cabinet are means to facilitate the opening and closing of the bed, as illustrated in FIG. 2 in phantom. Across the headboard is metal plate 45 and attached to the cabinet sides and the rear of the headboard is an elastic adjustable cord 47. At the outer edge of pallet 13 and running across substantially its full width is cross piece 49. Cross piece 49 projects beyond the outer edge of pallet 13 so that it will also support the inner edge of pallet 23 when bed 17 is fully extended. When the bed 17 is closed, cross piece 49 becomes the top section of upper front panel 13, and it butts against stiffening board 50.

Figure 3:
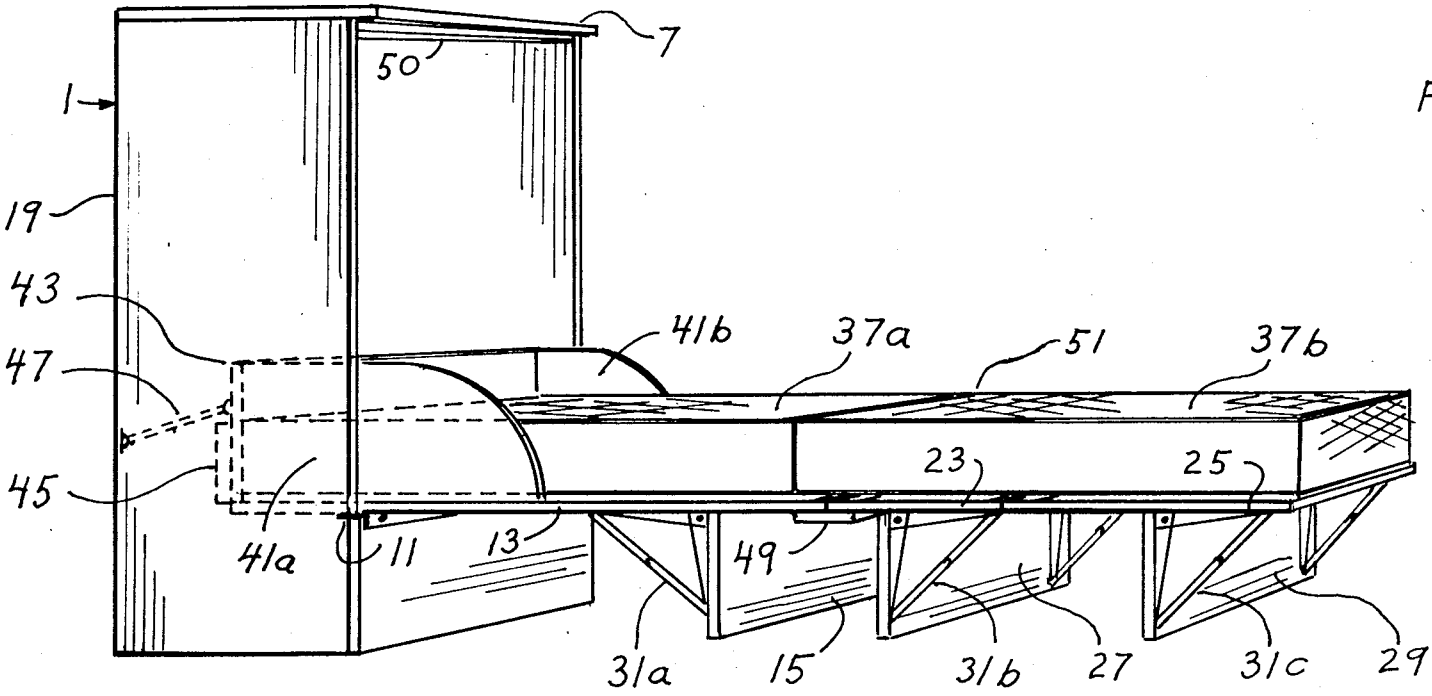
FIG. 3 is a perspective view of the present invention with the bed portion fully extended from the cabinet.

FIG. 3 illustrates the present invention in which bed 17 is in a fully extended position and shows pallets 13, 23 and 25 supported by support legs 15, 27, and 29, respectively; the legs are held in a locked position by collapsible brackets 31*a*, 31*b* and 31*c*, respectively. The two pieces 37*a* and 37*b* of mattress 37 are illustrated in the open position. While 37*a* and 37*b* may be separate pieces, they may also be joined at seam 51 which is designed to permit mattress portion 37*b* to be folded up and over mattress portion 37*a*. Seam 51 can be made of hinged fabric, preferably having double ply for reinforcement. Mattress 37 can be made of foam, laminated foam or inner spring construction so long as it can be bent or folded in half within the space provided by pallet 23 when bed 17 is folded.

Figure 4:
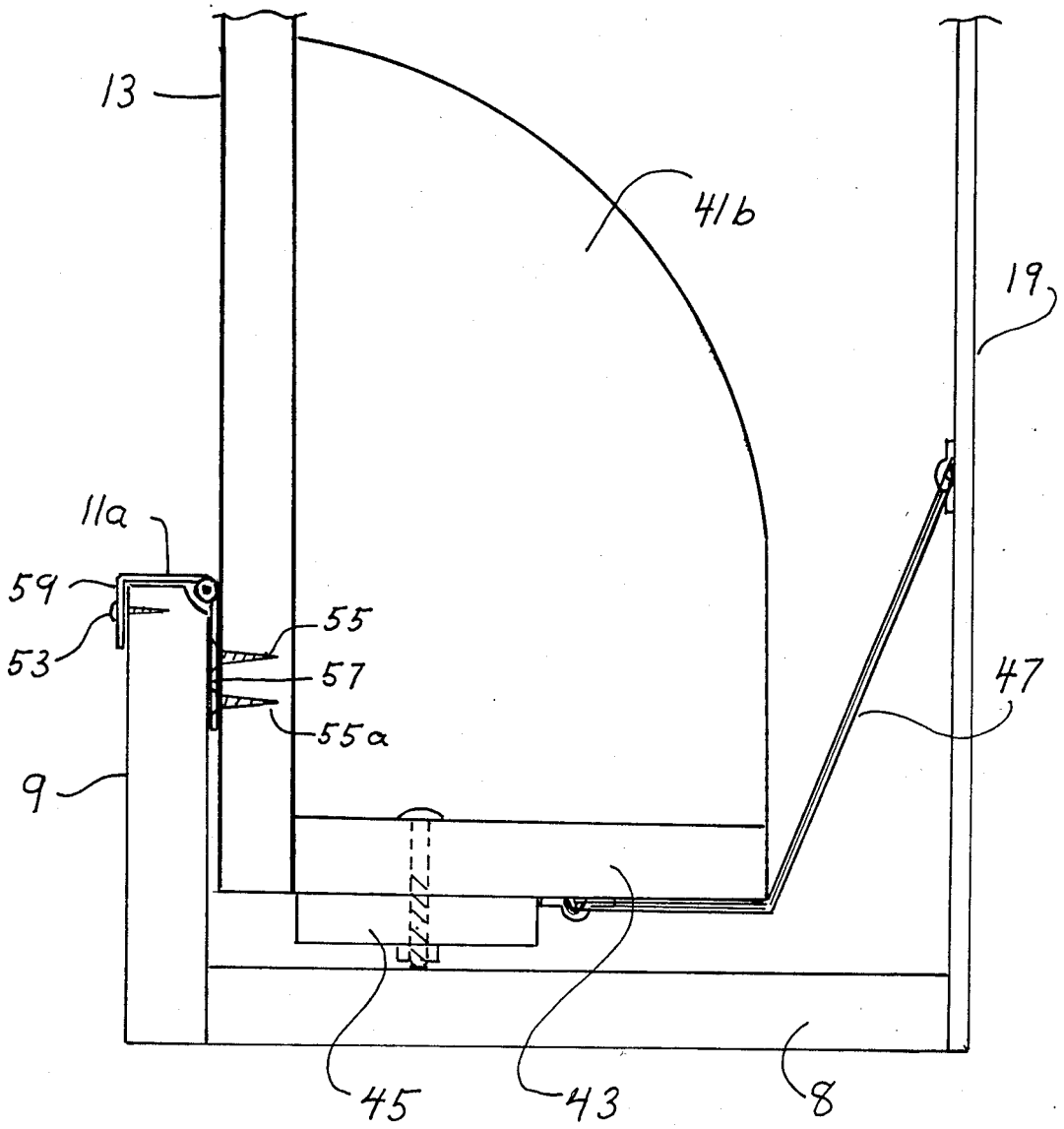
FIG. 4 is an enlarged partial side view along the line 4—4 in FIG. 1, illustrating a preferred means for detachably mounting the bed portion to the cabinet.

FIG. 4 shows in more detail and in the closed position the counterbalancing arrangement at the headboard and a preferred method of attaching the bed 17 in a readily detachable fashion to cabinet 1. This figure is an enlarged view showing a portion of innermost pallet 13, the left sideboard 41*b*, secured front panel 9, bottom 8 and back 19. Metal plate 45 is secured to headboard 43 and cord 47 is attached to headboard 43 and cabinet back 19. To attach bed 17 to cabinet 1, hinge 11*a* is secured to the bottom of pallet 13 by screws 55 and 55*a* through wing 57 of the hinge. The other wing 59 of hinge 11*a* is bent at 90° to conform to the top of secured front panel 9 and partially overlaps the front face of secured front panel 9. Hinge 11*a* is then fastened through overlapping wing 59 to the front face of secured front panel 9 by means of one or more screws 53. When screw 53 and any other screws that are used to secure wing 59 to secured front panel 9 are removed and cord 47 is released either from cabinet back 19 or headboard 43, the entire bed portion 17 is easily removed from cabinet 1 and just as easily reattached by reinserting screws 53 and reattaching cord 47. When bed 17 is removed from cabinet 1, the two components can be moved more readily from place to place.

Variations in the construction of the bed and the cabinet will be obvious to those skilled in the art in light of the foregoing disclosure. For example, hinge 11 can be a common piano hinge, in which case, to separate cabinet 1 and bed 17, back 19 would be removed and then the rear of hinge 11 would be unscrewed from the rear of secured front panel 9. Also support legs 27 and 29 can be rectangular metal frames, metal legs, or flat boards. A spring may be substituted for elastic cord 47. This and other variations are within the scope of the appended claims.

I claim:

1. A combination cabinet and folding bed wherein (a) the cabinet comprises two sides, a top, a back, and a segmented front having a lower section and an upper section, the lower section being secured to the two sides, the interior surface of said top having a recessed stiffening member transversing the extent thereof and forming an abutment stop, and rotating means connecting the upper section to the lower section so that the upper section can rotate from an upright position outwardly from the cabinet to a horizontal position, and (b) the folding bed consists of an inner pallet, a middle pallet and an outer pallet, the inner pallet also being the upper section of the segmented front, the three pallets being solid and hingedly connected so that they are adapted to form a continuous horizontal surface, each pallet having at least one supporting leg extending the width of each of said pallets and being collapsibly attached to a surface which is the under surface in the horizontal position and said legs being approximately equal in height to the height of the lower section of the segmented front said inner pallet having a lateral edge member adjacent said middle pallet adapted to abut said stiffening member when said folding bed is in the upright position.

2. A combination cabinet and folding bed as claimed in claim 1 wherein the supporting leg on the inner pallet is a flat board.

3. A combination cabinet and folding bed of claim 2 wherein the flat board in an open position serves as a shelf attached to the upper section of the segmented front when the folding bed is stored.

4. A combination cabinet and folding bed of claim 1 wherein the rotating means connecting the upper section of the segmented front to the lower section comprises interlocking means on the lower section and the upper section of the segmented front.

5. A combination cabinet and folding bed of claim 4 wherein the interlocking means can be readily separated.

6. A combination cabinet and folding bed of claim 5 wherein the folding bed includes a headboard vertically attached to the inner edge of the inner pallet and sideboards extending from the headboard along the sides of and attached to the inner pallet.

7. A combination cabinet and folding bed of claim 6 wherein an elastic means or spring is attached between the headboard and the cabinet to facilitate opening and closing the bed.

* * * * *